US007828697B1

(12) United States Patent
Oberrieder et al.

(10) Patent No.: US 7,828,697 B1
(45) Date of Patent: Nov. 9, 2010

(54) PORTABLE PERSONAL TRAINING DEVICE

(75) Inventors: John P. Oberrieder, Olathe, KS (US); Paul E. Skelton, Overland Park, KS (US); Warren R. Stevens, Olathe, KS (US); Brian M. Sandefur, Lawrence, KS (US); David F. Lammers-Meis, Olathe, KS (US); Justin R. Lyons, Olathe, KS (US)

(73) Assignee: Garmin Switzerland GmbH (CH)

( * ) Notice: Subject to any disclaimer, the term of this patent is extended or adjusted under 35 U.S.C. 154(b) by 991 days.

(21) Appl. No.: 11/234,370

(22) Filed: Sep. 23, 2005

(51) Int. Cl.
*A63B 71/00* (2006.01)

(52) U.S. Cl. ..... 482/8; 482/1; 482/9

(58) Field of Classification Search ..... 482/1–9, 482/900–902; 434/247
See application file for complete search history.

(56) References Cited

U.S. PATENT DOCUMENTS

| | | | | |
|---|---|---|---|---|
| 5,219,067 | A | 6/1993 | Lima et al. | |
| 5,781,155 | A | 7/1998 | Woo et al. | |
| D400,112 | S | 10/1998 | Rider | |
| 6,564,075 | B1 | 5/2003 | Mitamura | |
| D509,760 | S | 9/2005 | Burrell et al. | |
| 6,950,685 | B2 * | 9/2005 | Barras et al. | 455/575.1 |
| 6,976,937 | B2 | 12/2005 | Chen | |
| D516,440 | S | 3/2006 | Yan | |
| D518,742 | S | 4/2006 | Yan | |
| 7,042,337 | B2 | 5/2006 | Borders et al. | |
| 2005/0288154 | A1 * | 12/2005 | Lee et al. | 482/3 |
| 2006/0007788 | A1 * | 1/2006 | Cunningham | 368/73 |

FOREIGN PATENT DOCUMENTS

DE 20202571 U1 * 8/2002

OTHER PUBLICATIONS

Garmin Forerunner 201 Owner's Manual, Apr. 2005.
Royaltek Sport GPS displayed at the Taipei COMPUTEX show sometime between May 31, 2005 and Jun. 4, 2005.
Product Description for that Paroos G-100 Launched in Jul. 2005, in Korea.
Timeline for that Paroos G-100 Launched in Jul. 2005, in Korea.
Pocket Lint article describing the Navman Sport Tool GPS, dated Jan. 2005.
TechDigest UK article describing the Navman Sport Tool GPS, dated Jan. 2005.

* cited by examiner

*Primary Examiner*—Glenn Richman
(74) *Attorney, Agent, or Firm*—Samuel M. Korte

(57) ABSTRACT

A portable personal training device is disclosed. The device generally includes a location determining component operable to determine a geographic location of the device, a housing having a first portion and a second portion coupled to the first portion at an angle, and a strap operable to secure the housing to a user's wrist such that the first portion is operable to be positioned on a top of the wrist and the second portion is operable to be positioned offset from the top of the wrist. Such a configuration facilitates both wearing and operation of the device.

12 Claims, 3 Drawing Sheets

PORTABLE PERSONAL TRAINING DEVICE

BACKGROUND OF THE INVENTION

1. Field of the Invention

The present invention relates to portable personal training devices. More particularly, the invention relates to a portable personal training device having a housing with a first portion and a second portion coupled to the first portion at an angle to facilitate use and positioning of the device.

2. Description of the Related Art

Athletes and fitness buffs often wish to monitor and record certain performance values while they train and exercise. For example, runners, bikers, and other athletes often track and record their distance, speed, pace, heart rate, and/or calories burned during a workout so that they can compare these performance values to benchmark values or values from previous workouts.

Historically, these performance values have been monitored and recorded with various different stand-alone components including stop watches, pedometers, heart rate monitors, and calorie calculators or charts. Those skilled in the art will appreciate that use of all these different components is time-consuming, cumbersome, and often inaccurate.

To alleviate some of these problems, portable personal training devices have been developed to simplify and improve exercise monitoring. One such device manufactured by Garmin International, Inc. of Olathe, Kans., can be worn on a user's wrist or forearm, includes a GPS receiver, and is operable to continuously monitor and track the user's heart rate, speed, distance traveled, pace, and calories burned and to provide directions or routes to desired destinations or along desired routes.

Although portable personal training devices are far superior to the stand-alone components discussed above, they are often bulky, cumbersome, and difficult to wear. Specifically, existing portable personal training devices often include a location determining component and associated antenna that must be housed in proximity with other device components to enable the beneficial functionality described above. Unfortunately, location determining components and antennas increase housing size and often render conventional device housings cumbersome or difficult to wear. For example, existing portable personal training devices often move or shift on a user's wrist, especially as a user sweats, due to their cumbersome design.

Further, due to space and design constraints, portable personal training devices house antennas in positions that often reduce the ability of the devices to acquire satellite signals during user movement. For instance, antennas housed such that they are worn on top of a user's wrist often have difficulty receiving satellite signals as individuals typically walk and run with the top of their wrists facing the horizon and away from the satellite-containing sky.

SUMMARY OF THE INVENTION

The present invention solves the above-described problems and provides a distinct advance in the art of portable personal training devices. More particularly, the present invention provides a portable personal training device having a housing that is less cumbersome, more comfortable and secure to wear, and better able to position its antenna.

One embodiment of the present invention is a portable personal training device comprising a location determining component, a housing enclosing at least a portion of the location determining component, and a strap for securing the housing to a user. The housing includes a first portion and a second portion coupled to the first portion at an angle and the strap is operable to secure the housing to the user's wrist such that the first portion is operable to be positioned on a top of the wrist and the second portion is operable to be positioned offset from the top of the wrist. Such a configuration results in a more comfortable and secure design due to the positioning of the second portion offset from the top of the wrist.

Another embodiment of the present invention is a portable personal training device comprising a location determining component having an antenna, a display coupled with the location determining component, a housing enclosing at least a portion of the location determining component, and a strap for securing the housing to a user. The housing includes a first portion at least partially housing the display and a second portion, coupled to the first portion at an angle, housing at least a portion of the antenna. The strap is operable to secure the housing to the user's wrist such that the first portion is operable to be positioned on a top of the wrist and the second portion is operable to be positioned offset from the top of the wrist.

Another embodiment of the present invention is a portable personal training device comprising a location determining component having an antenna, a performance monitoring component, a display coupled with the location determining component and performance monitoring component, a plurality of inputs, a housing enclosing at least a portion of the location determining component and performance monitoring component, and a strap for securing the housing to a user. The housing includes a first portion at least partially housing the display and a second portion, coupled to the first portion at an angle, at least partially housing the antenna. The first portion further includes a top having at least one of the inputs associated therewith and a side having at least one of the other inputs associated therewith. The strap is operable to secure the housing to the user's wrist such that the first portion is operable to be positioned on a top of the wrist and the second portion is operable to be positioned offset from the top of the wrist to facilitate reception of satellite signals by the antenna during movement by the user.

Other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein.

Figure 1:
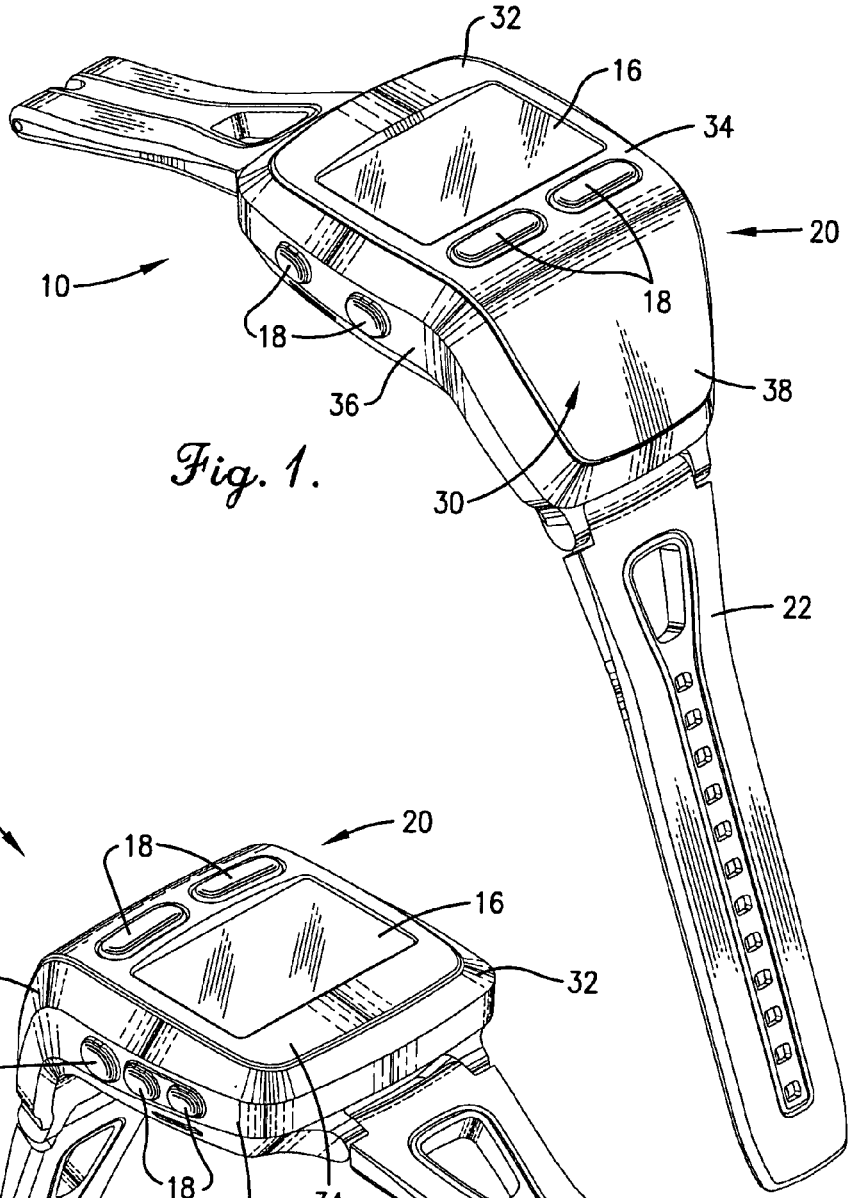
FIG. 1 is a front perspective view of a portable personal training device constructed in accordance with various embodiments of the present invention.
Figure 2:
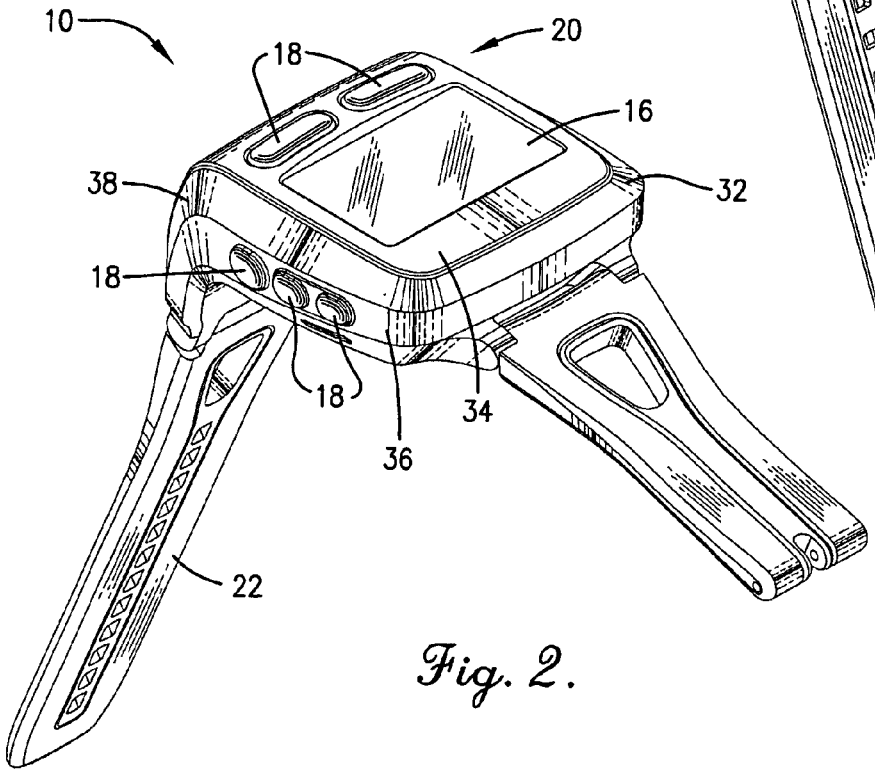
FIG. 2 is a rear perspective view of the device of FIG. 1.
Figure 3:
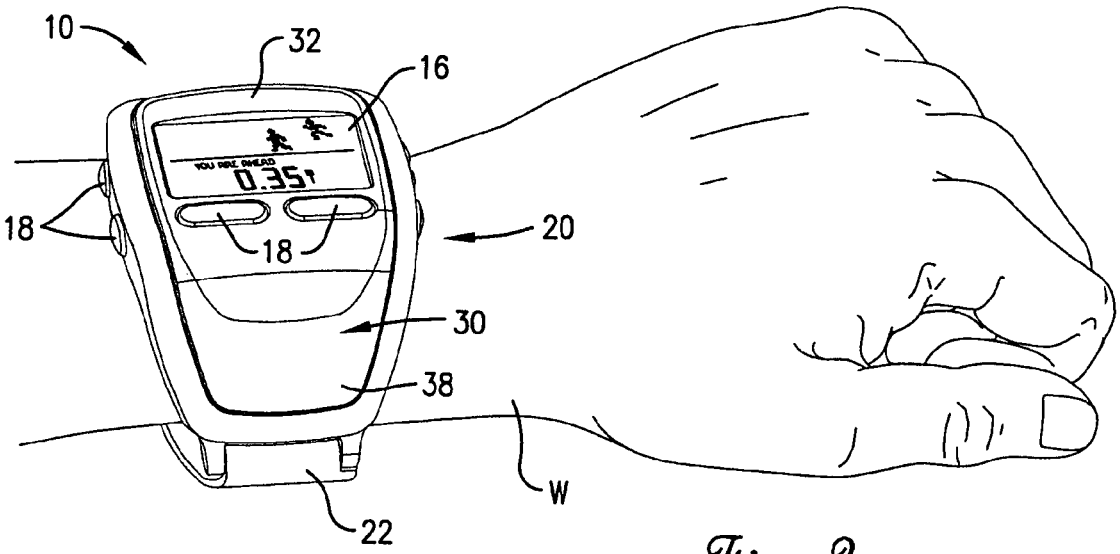
FIG. 3 is a front perspective view of the device of FIGS. 1-2 shown strapped to a user's wrist or forearm.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

The following detailed description of the invention references the accompanying drawings which illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Turning now to the drawing figures, and particularly FIGS. 1-4, a portable personal training device 10 constructed in accordance with a preferred embodiment of the invention is illustrated. The portable personal training device 10 is especially suited for use by a jogger, runner, biker, hiker, walker, swimmer, or other athlete or fitness buff and is preferably operable to continuously monitor and track the user's heart rate, speed, distance traveled, pace, cadence, calories burned and other performance values and to provide locations, directions or routes to a desired destination or along a desired route as described in detail herein.

The present invention can be implemented in hardware, software, firmware, or a combination thereof, but is preferably implemented with the components illustrated in FIGS. 1-4. Specifically, a preferred embodiment of the device 10 broadly comprises a performance monitoring component 12; a location determining component 14; a display 16; one or more inputs 18; and a housing 20 which encloses and protects the other components from moisture, vibration, and impact associated with the exercise or movement of the user. The device 10 may also include a strap 22 operable to removably secure the housing 20 to the user's forearm or wrist W and a heart rate monitor 24.

The performance monitoring component 12 may comprise one or more processors, controllers, or other computing devices and preferably includes internal or external memory. The functions of the performance monitor component described herein may be performed by hardware, software, firmware or a combination thereof.

The performance monitoring component 12 receives location information from the location determining component 14, monitors and calculates performance values and information related to the user's exercise, and displays information related to these performance values on the display 16. The performance values may include, for example, the user's heart rate, speed, total distance traveled, total distance goals, speed goals, pace, cadence, and calories burned. Supplemental performance information may be entered into the performance monitor component from an external source. Certain aspects of the performance monitor component are disclosed in U.S. patent application Ser. No. 10/462,968, entitled APPARATUS USING GPS DERIVED DATA FOR EXERCISE, which is incorporated herein by specific reference.

The location determining component 14 is preferably a global positioning system (GPS) receiver, and provides, in a substantially conventional manner, geographic location information for the device 10. The location determining component may be, for example, a GPS receiver much like those provided in products by Garmin Corporation and disclosed in U.S. Pat. No. 6,434,485, which is incorporated herein by specific reference.

In general, the GPS is a satellite-based radio navigation system capable of determining continuous position, velocity, time, and direction information for an unlimited number of users. Formally known as NAVSTAR, the GPS incorporates a plurality of satellites which orbit the earth in extremely precise orbits. Based on these precise orbits, GPS satellites can relay their location to any number of receiving units.

The GPS system is implemented when a device specially equipped to receive GPS data such as the device 10 begins scanning radio frequencies for GPS satellite signals. Upon receiving a radio signal from a GPS satellite, the device can determine the precise location of that satellite via one of different conventional methods. The device will continue scanning for signals until it has acquired at least three different satellite signals. Implementing geometrical triangulation, the receiver utilizes the three known positions to determine its own two-dimensional position relative to the satellites. Acquiring a fourth satellite signal will allow the receiving device to calculate its three-dimensional position by the same geometrical calculation. The positioning and velocity data can be updated in real time on a continuous basis by an unlimited number of users.

Although GPS enabled devices are often used to describe navigational devices, it will be appreciated that satellites need not be used to determine a geographic position of a receiving unit since any receiving device capable of receiving the location from at least three transmitting locations can perform basic triangulation calculations to determine the relative position of the receiving device with respect to the transmitting locations. For example, cellular towers or any customized transmitting radio frequency towers can be used instead of satellites. With such a configuration, any standard geometric triangulation algorithm can be used to determine the exact location of the receiving unit. In this way, personal hand held devices, cell phones, intelligent appliances, intelligent apparel, and others can be readily located geographically, if appropriately equipped to be a receiving unit.

Figure 5:
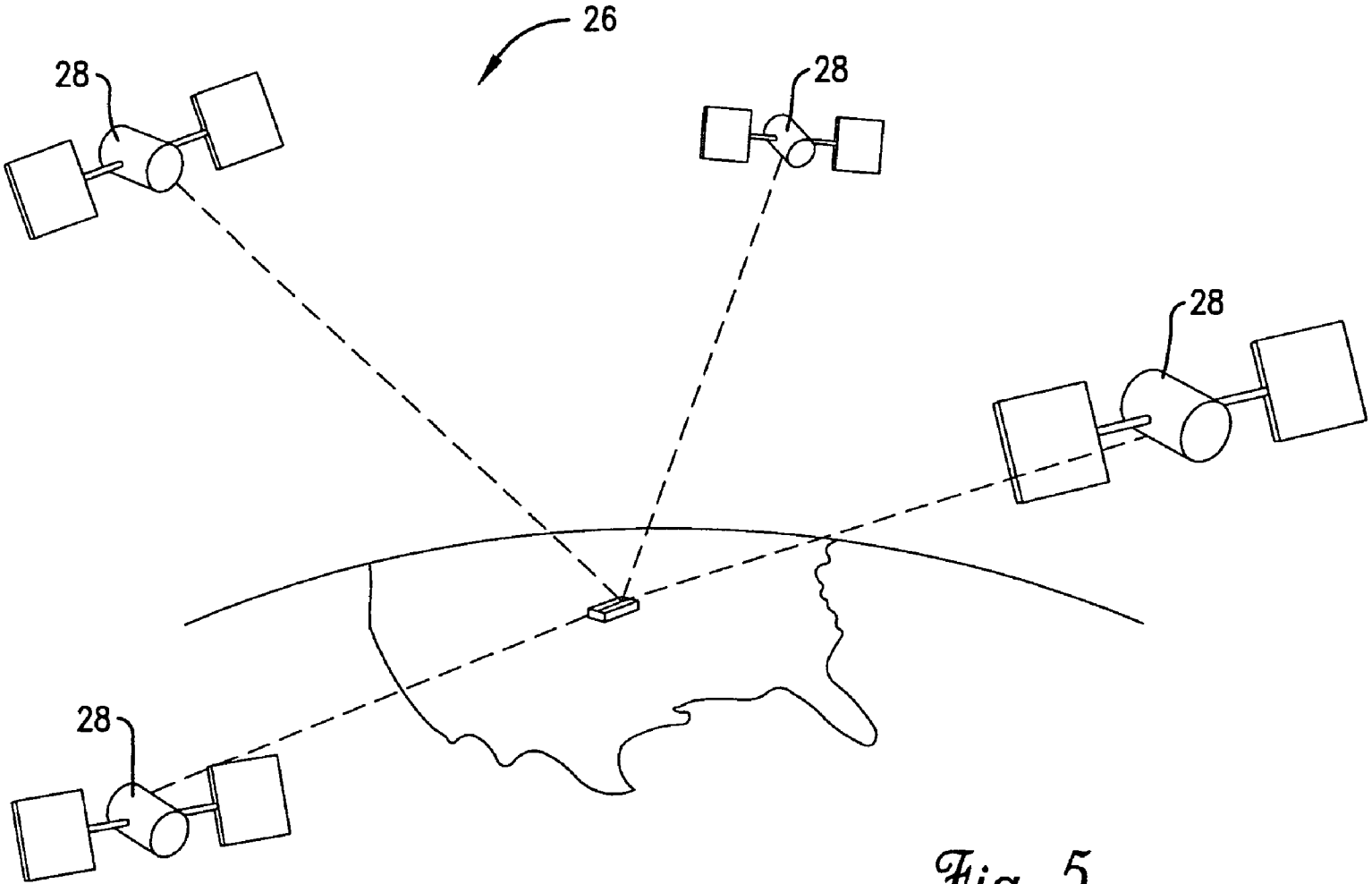
FIG. 5 is a schematic diagram of a Global Positioning System (GPS) that may be used to implement certain aspects of the present invention.

FIG. 5 shows one representative view of a GPS denoted generally by reference numeral 26. A plurality of satellites 28 are in orbit about the Earth. The orbit of each satellite is not necessarily synchronous with the orbits of other satellites and, in fact, is likely asynchronous. A GPS receiver device such as the device 10 described in connection with preferred embodiments of the present invention is shown receiving spread spectrum GPS satellite signals from the various satellites.

The spread spectrum signals continuously transmitted from each satellite 28 utilize a highly accurate frequency standard accomplished with an extremely accurate atomic clock. Each satellite 28, as part of its data signal transmission, transmits a data stream indicative of that particular satellite. The GPS receiver device 10 must acquire spread spectrum GPS satellite signals from at least three satellites for the GPS receiver device to calculate its two-dimensional position by triangulation. Acquisition of an additional signal, resulting in signals from a total of four satellites, permits the GPS receiver device to calculate its three-dimensional position.

The location determining component 14 of the present invention may include one or more processors, controllers, or other computing devices and memory for storing information accessed and/or generated by the processors or other computing devices. The location determining component 14 is operable to receive navigational signals from the GPS satellites 28 to calculate a position of the device as a function of the signals. The location determining component 14 is also operable to calculate a route to a desired location, provide instructions to navigate to the desired location, display maps and other information on the display screen, and to execute other functions described herein. The memory may store cartographic data and routing used by or generated by the location determining component's computing devices. The memory may be integral with the location determining component, stand-alone memory, or a combination of both. The memory may include, for example, removable TransFlash cards.

The location determining component 14 also includes an antenna 30 to assist the location determining component 14 in receiving signals. The antenna is preferably a GPS patch antenna or helical antenna but may be any other type of antenna that can be used with navigational devices. Alternatively, the antenna may be operable to broadcast signals and/or transmit data to and from other devices.

The display 16 is coupled with the performance monitoring component 12 and the location determining component 14 for displaying performance information, location information and directions generated by the performance monitoring component and the location determining component. The display 16 is preferably an LCD display capable of displaying both text and graphical information. The display may also be backlit such that it may be viewed in the dark or other low-light environments. One example of a display that may be used with the present invention is a 100×64 pixel display on FSTN display and a bright white LED backlight.

The inputs 18 are preferably positioned such that they may be easily accessed by the user during exercise. The inputs 18 may include descriptive markings that identify their function. Preferably, the inputs 18 are positioned such that the user may operate the inputs with one hand, thus enabling the user to continue exercising while operating the device, as is described below in detail. The inputs may be buttons, switches, keys, an electronic touchscreen associated with the display, voice recognition circuitry, or any other elements capable of controlling the performance monitoring component and location determining component.

The device 10 may also include a speaker for providing audible instructions and feedback, a microphone for receiving voice commands, an infrared port for wirelessly receiving and transmitting data and other information from and to nearby electronics, and other information, and a cellular or other radio transceiver for wirelessly receiving and transmitting data from and to remote devices. For example, the radio transceiver may permit the device to communicate with a remote server with exercise-related data, cartographic map data, and other information stored thereon.

The device 10 may also include a number of I/O ports that permit data and other information to be transferred to and from the performance monitoring component 12 and the location determining component 14. The I/O ports may include a secure digital card slot for receiving removable secure digital cards and a USB port for coupling with a USB cable connected to another computing device such as a personal computer. Navigational software, cartographic maps and other data and information may be loaded in the device 10 via the I/O ports, the wireless transceivers, or the infrared port mentioned above.

The components described above need not be physically connected to one another since wireless communication among the various depicted components is permissible and intended to fall within the scope of the present invention.

The housing 20 is generally operable to house the various elements discussed above and is preferably constructed from a suitable lightweight and impact-resistant material such as, for example, plastic, nylon, aluminum, or any combination thereof. The housing 20 may also include one or more appropriate gaskets or seals to make it substantially waterproof or resistant. The housing 20 may further include a location for a battery, or other power source for powering the electronic components of the device 10.

Figure 4:
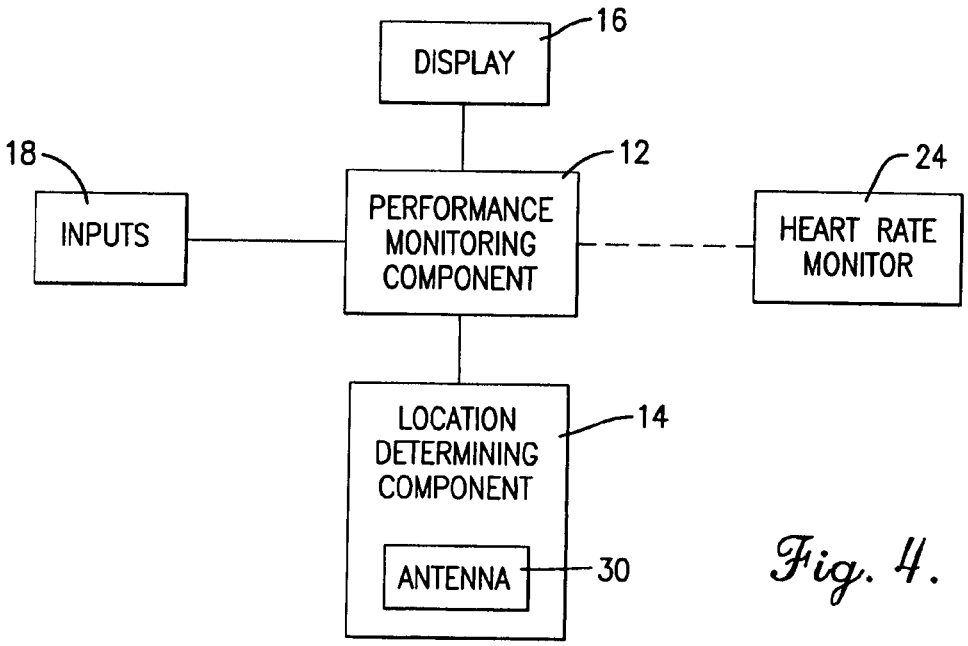
FIG. 4 is a block diagram broadly depicting some of the components of the device of FIGS. 1-3.

As shown in FIGS. 1-4, the housing includes a first portion 32, having a top 34 and sides 36, and a second portion 38 coupled to the first portion 32 at an angle. The angled coupling of the first portion 32 and the second portion 38 provides the housing 20 with a contour that generally corresponds to the arcuate shape of a user's wrist W for positioning thereon. Utilizing the strap 22 discussed below, the first portion 32 may be positioned on a top of the user's wrist W and the second portion 38 may be positioned offset from the top of the user's wrist W, such as by being positioned in proximity to an interior side of the wrist W, as shown in FIG. 4.

Such positioning of the first portion 32 and second portion 38 on the user's wrist W renders the device 10 more comfortable to wear as the first portion 32 may generally abut the top of the wrist W and the second portion 38 may generally abut an interior side or other sloping portion of the wrist W due to the angled coupling of the portions 32, 38. Further, the angled coupling of the first portion 32 and second portion 38 enables the housing 20 to remain securely attached to the user with the strap 22, even during intense movement or exercise, as the number of gaps and spaces between the user's wrist W and the housing 20 is limited.

As will be appreciated by those skilled in the art, the housing 20 may be reversed on the user's wrist W such that the first portion 32 is positioned on a bottom of the wrist W and the second portion 38 is positioned offset from the bottom of the wrist W. Such positioning may achieve a generally similar affect as the other positioning discussed herein.

The angle formed between the first portion 32 and second portion 38 is sufficient to enable the first portion 32 to rest on the top of the wrist W and the second portion to be offset from the top of the wrist W as described above. Preferably, the angle between the first portion 32 and second portion 38 is between 15 and 60 degrees. However, the angle may be any non-zero angle to provide the desired form.

The first portion 32 and the second portion 38 are also preferably integral, such that the combination of the portions 32, 38 forms a common housing for the various elements of the device 10. However, the portions 32, 38 may non-integral and coupled through a coupling element, such as a hinge or the strap 22 to form the desired angle.

The first portion 32 preferably houses at least a portion of the display 16. As shown in FIGS. 1-4, the top 34 of the first portion 32 may be utilized to house the display 16 to facilitate viewing of the display 16 during user movement. Further, at least one of the inputs 18 is preferably associated with the first portion 32 to enable the user to easily manipulate the input with one-hand during movement or exercise.

Preferably, at least one input is associated with the top 34 of the first portion 32 and at least one input is associated with the sides 36 of the first portion 32 to provide a plurality of inputs that may be functioned by the user with one hand. For example, during exercise, the user may use his or her index finger to function one input 18 on the top 34 of the first portion 32 and simultaneously use his or her thumb to function other inputs 18 on the sides 36 of the first portion 32.

The second portion 38 preferably houses at least a portion of the antenna 30. In various embodiments, the second portion 38 may entirely enclose the antenna 30 to reduce inadvertent and possible dangerous user contact with the antenna 30 during exercise. Further, housing of the antenna 30 at least partially within the second portion 38 advantageously increases the ability of the antenna to receive signals, such as satellite-generated GPS navigation signals, during movement or exercise by the user.

Specifically, housing of the antenna 30 at least partially within the second portion 38 enables the antenna 30 to be oriented towards the satellite-containing sky, and away from the horizon and the user, during movement or exercise by the user. As should be appreciated, the user will generally walk or run with the top of his wrist facing outward and parallel to the longitudinal axis of his body, while portions offset from the top of his wrists, such as an interior side of his wrist, face upward and perpendicular to the longitudinal axis of his body during exercise or movement. Thus, positioning at least a portion of the antenna 30 within the second portion 38 facilitates reception of satellite navigation signals by orienting the antenna 30 towards the sky when the user exercises.

The shape and dimensions of the housing 20 also facilitate operation of the device 10 with one hand, as the first portion 32 is preferably configured to have dimensions similar to those of a conventional wristwatch. For example, the first portion 32 is preferably sized and configured to be poisoned upon the top of the user's wrist W and the second portion 38 is preferably size and configured to be positioned offset from the top of the user's wrist W, as described above. Additionally, the housing 20 has a large surface area to contain components required by the location determining component 14 and a generally flat, rounded, profile to reduce harmful user contact with the device 10.

Thus, in embodiments where the first portion 32 and second portion 38 are integral, the housing 20 provides a continuous rounded profile that is both aesthetically pleasing and functional to conform the user's wrist W, remain securely attached to the wrist W during exercise, and prevent injury caused by protruding or sharp objects.

The strap 22 is preferably made of a lightweight and resilient thermoplastic elastomer or fabric such that the strap may encircle the user's arm without discomfort while still adequately securing the housing 20 to the user's forearm or wrist. The strap 22 is removably secured to the housing 20 by the attachment of securing elements to corresponding connecting elements. The securing elements and the connecting elements may be any conventional reciprocal connecting and securing pair, such as a hooks, latches, clamps, snaps, buttons, etc.

Preferably, one end of the strap 22 is secured to the first portion 32 and another end of the strap 22 is secured to the second portion 38 such that when worn by the user the longitudinal axis of the device 10 is generally perpendicular to the longitudinal axis of the user's arm to facilitate positioning of both the first portion 32 on the top of the wrist W and the second portion 38 offset from the top of the wrist W.

The strap 22 is attached to the user's forearm by encircling the strap around the user's forearm and securing the strap to itself through the use of hooks, latches, clamps, or other conventional fastening elements, thereby securing the housing 20 to the user's forearm. Alternatively, the strap 22 may be configured to attach to other parts of the user, such as the user's leg, waist, wrist, or upper arm.

The heart rate monitor 24 preferably includes a pair of heart rate sensors carried on a strap designed to be worn below the user's breastplate. The sensors are connected to a transmitter which wirelessly transmits heart rate data to the performance monitoring component. When the user puts on the heart rate monitor 24, it begins transmitting heart rate data plus a unique, randomly-selected code. When the device 10 is turned on, it begins "listening" for data from the heart rate monitor 24. Once the device 10 "hears" two or more transmissions of heart rate data that contain the same unique code, it pairs with the heart rate monitor 24, creating a unique wireless link.

Once paired, the device 10 will never receive conflicting signals from another heart rate monitor, so the user can exercise in close proximity to other heart rate monitors without fear of interference. If the device loses a heart rate signal, the pairing process begins again automatically.

A user may operate the device 10 by manipulating the inputs 18. For example, the user may enable navigation capabilities of the location determining component 14 or performance monitoring capabilities of the performance monitoring component 12. The navigation capabilities may allow the user to display the user's current geographic location on the display 16, map the user's location on the display 16, chart a desired course of travel on the display, or find a desired location on a map generated on the display. Additional navigation capabilities, such as conventional functions found in known navigation units, may also be provided by the location determining component 14. Supplemental navigational information, such as additional maps or geographical information, may be entered into the location determining component from an external source, such as a computer.

The performance monitoring capabilities may include monitoring the user's heart rate, speed, total distance traveled, total distance goals, speed goals, pace, cadence, calories burned, etc. Further, the performance monitoring capabilities may include monitoring or displaying the above attributes in combination with location information related to the location determining component 14.

Other features and aspects that may be included in the present invention are described in U.S. Pat. Nos. 6,837,827; 6,853,955; and patent application Ser. No. 10/786,377, entitled WEARABLE GPS DEVICE and filed on Feb. 25, 2004, all of which are incorporated by reference into the present application.

Although the invention has been described with reference to the preferred embodiment illustrated in the attached drawing figures, it is noted that equivalents may be employed and substitutions made herein without departing from the scope of the invention as recited in the claims. For example, some of the components of the device 10 can also be embodied as computer hardware circuitry or as a computer-readable program, or a combination of both. More specifically, the programs can be structured in an object-orientation using an object-oriented language such as Java, Smalltalk, C++, and others, and the programs can be structured in a procedural-orientation using a procedural language such as C, PASCAL, and others. The software components communicate in any of a number of means that are well-known to those skilled in the art, such as application program interfaces (A.P.I.) or inter-process communication techniques such as remote procedure call (R.P.C.), common object request broker architecture (CORBA), Component Object Model (COM), Distributed Component Object Model (DCOM), Distributed System Object Model (DSOM) and Remote Method Invocation (RMI). Any programming methodology, programming language, programming interface, operating system, or computing environment, now known or hereafter developed, can be readily deployed, without departing from the tenets of the present invention and all such implementation specific embodiments are intended to fall within the broad scope of the present invention.

Having thus described the preferred embodiment of the invention, what is claimed as new and desired to be protected by Letters Patent includes the following:

1. A portable personal training device comprising:

a location determining component operable to determine a geographic location of the device, the location determining component including an antenna;

a display coupled with the location determining component and operable to display location information;

an integral housing enclosing at least a portion of the location determining component, the housing including a first portion at least partially housing the display, the first portion having a first bottom part, and a second portion extending from the first portion at an angle to provide the housing with an L-shaped configuration, the second portion at least partially housing the antenna and having a second bottom part; and a strap operable to secure the housing to a user's wrist such that the first bottom part of the first portion is operable to contact the top of the wrist and the second bottom part of the second portion is operable to contact the side of the wrist such that the second portion is at least partially below the first portion.

2. The device of claim 1, wherein the antenna is operable to receive GPS signals and the location determining component determines the geographic location of the device utilizing the GPS signals.

3. The device of claim 2, wherein the housing of the antenna in the second portion facilitates acquisition of the GPS signals during movement by the user.

4. The device of claim 1, further including a plurality of inputs associated with the first portion.

5. The device of claim 1, wherein the first portion includes a top and a side and the inputs are associated with the top and the side of the first portion to facilitate one-hand operation by the user.

6. The device of claim 1, further including a performance monitoring component coupled with the location determining component and enclosed at least partially by the housing.

7. The device of claim 6, wherein the performance monitoring component is operable to couple with a heart rate monitor.

8. A portable personal training device comprising:

a location determining component operable to determine a geographic location of the device, the location determining component including an antenna;

a performance monitoring component operable to calculate performance information;

a display coupled with the location determining component and the performance monitoring component, the display operable to display location and performance information;

a plurality of inputs coupled with the location determining component and the performance monitoring component;

an integral housing enclosing at least a portion of the location determining component and the performance monitoring component, the housing including a first portion at least partially housing the display, the first portion including a first bottom part, a top having at least one of the inputs associated therewith and a side having at least one of the other inputs associated therewith, and a second portion at least partially housing the antenna, the second portion extending from the first portion at an angle to provide the housing with an L-shaped configuration such that the antenna is positioned entirely below the display, the second portion having a second bottom part; and a strap operable to secure the housing to a user's wrist such that the first bottom part of the first portion is operable to contact the top of the wrist and the second bottom part of the second portion is operable to contact the side of the wrist to facilitate reception of satellite signals by the antenna during movement by the user.

9. The device of claim 8, wherein the performance monitoring component is operable to couple with a heart rate monitor.

10. The device of claim 8, wherein the antenna is operable to receive GPS signals and the location determining component determines the geographic location of the device utilizing the GPS signals.

11. The device of claim 8, wherein the antenna is enclosed entirely within the housing such that the antenna does not contact the user during movement.

12. The device of claim 7, wherein housing the display in the first portion facilitates viewing of the display by the user during movement.

* * * * *